US008992048B2

(12) United States Patent
Yu et al.

(10) Patent No.: US 8,992,048 B2
(45) Date of Patent: Mar. 31, 2015

(54) CONNECTOR AND LED LIGHT BAR

(71) Applicant: Shenzhen China Star Optoelectronics Technology Co., Ltd., Shenzhen, Guangdong (CN)

(72) Inventors: Gang Yu, Shenzhen (CN); Jiaqiang Wang, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 183 days.

(21) Appl. No.: 13/701,081

(22) PCT Filed: Nov. 26, 2012

(86) PCT No.: PCT/CN2012/085246
§ 371 (c)(1),
(2) Date: Nov. 30, 2012

(87) PCT Pub. No.: WO2014/075343
PCT Pub. Date: May 22, 2014

(65) Prior Publication Data

US 2014/0247593 A1 Sep. 4, 2014

(30) Foreign Application Priority Data

Nov. 16, 2012 (CN) ..... 2012 1 0464991

(51) Int. Cl.

| | |
|---|---|
| ***F21S 4/00*** | (2006.01) |
| ***F21V 21/00*** | (2006.01) |
| ***F21V 23/06*** | (2006.01) |
| ***F21V 23/04*** | (2006.01) |
| ***H01R 13/00*** | (2006.01) |

(52) U.S. Cl.
CPC .. *F21S 4/008* (2013.01); *F21S 4/00* (2013.01); *F21V 23/04* (2013.01); *F21V 23/06* (2013.01); *H01R 13/00* (2013.01)
USPC ..... 362/249.02

(58) Field of Classification Search
CPC ..... F21Y 2101/02; H05K 2201/10106; H05K 2201/10189; H05K 7/1457; H05K 5/0247; G06F 1/189; H01L 2924/12041; H01L 2224/73265; H01L 2225/06524; H01L 23/481; F21V 19/001; F21V 23/06; F21V 23/004; F21V 23/04; F21S 48/115; F21S 4/08; F21S 4/008; H01H 71/08; H01B 7/00; H01R 13/00; A01B 12/006
USPC ..... 362/217.13, 217, 17
See application file for complete search history.

(56) References Cited

U.S. PATENT DOCUMENTS

| | | | | |
|---|---|---|---|---|
| 2012/0008319 | A1* | 1/2012 | Pohlert et al. | 362/235 |
| 2012/0181935 | A1* | 7/2012 | Velazquez | 315/132 |
| 2013/0016500 | A1* | 1/2013 | Tress | 362/133 |

* cited by examiner

*Primary Examiner* — Donald Raleigh
(74) *Attorney, Agent, or Firm* — Andrew C. Cheng

(57) ABSTRACT

The present invention discloses a connector and an LED light bar. The connector includes: an input module and an output module, wherein the input module and the output module being electrically connected; the input module comprising at least two input interfaces, the input interface being for connecting to an external power supply, the output module being for electrical connection to all LEDs in at least two external areas. As such, the present invention realizes the use of a connector to control LEDs in a plurality of areas to increase the utilization of the connector and simplify the LED light bar structure. In the mean time, the improvement of the connector utilization results in the reduction in the number of connectors used so as to reduce the cost of LED light bar.

15 Claims, 2 Drawing Sheets

CONNECTOR AND LED LIGHT BAR

BACKGROUND OF THE INVENTION

1. Field of the Invention

The present invention relates to the field of light-emitting diode (LED) light source techniques, and in particular to a connector and LED light bar.

2. The Related Arts

Due to the advantages of low power consumption, high luminance and long life span, LED light bar is widely applied to many fields, such as, furniture, car, advertisement, lighting, boats and home decoration. As LED technique develops and the demands on LED increase, LED light bar also becomes more complex.

In known technique, LED light bar usually comprises LED, single-jack connector and circuit board. The LED and the single-jack connector are disposed on the circuit board. LED is connected through the single-jack connector to the external power supply to obtain electricity for lighting. However, because of the limitation of the single-jack connector, a connector can only provide limited number of LED for connecting to external power supply. In a more complex LED light bar, more connectors will be required to supply the power, resulting in higher cost of light bar as well as inconvenience of LED light bar control.

SUMMARY OF THE INVENTION

The technical sue to be addressed by the present invention is to provide an LED light bar, for improving the utilization of the connector and simplifying design structure.

The present invention provides a connector, which comprises: an input module and an output module, wherein the input module and the output module being electrically connected: the input module comprising at least two input interfaces, the input interface being a jack-type interface, the jack-type interface being for plugging in one end of a flexible cable, the other end of the flexible cable being for connecting to an external power supply; the output module comprising a same number of output interfaces as the input interfaces, each output interface being for electrical connection to all LEDs in an external area, each output interface being electrically connected to a corresponding input interface.

The present invention provides a connector, which comprises: an input module and an output module, wherein the input module and the output module being electrically connected; the input module comprising at least two input interfaces, the input interface being for connecting to an external power supply, the output module being for electrical connection to all LEDs in at least two external areas.

According to a preferred embodiment of the present invention, the input interface is a jack-type interface.

According to a preferred embodiment of the present invention, the jack-type interface is for plugging in one end of a flexible cable, and the other end of the flexible cable is for connecting to an external power supply.

According to a preferred embodiment of the present invention, the output module comprises a same number of output interfaces as the input interfaces, and each output interface is for electrical connection to all LEDs in an external area.

According to a preferred embodiment of the present invention, the input module is located on a front side of the connector and the output module is located on a back side of the connector.

According to a preferred embodiment of the present invention, the connector has a shape rectangle or square.

The present invention provides an LED light bar, which comprises: a circuit board, LEDs and a connector; the LEDs and the connector being disposed on the circuit board, the circuit board being disposed with at least two areas for disposing LEDs, the connector comprising an input module and an output module, wherein the input module and the output module being electrically connected; the input module comprising at least two input interfaces, the input interface being for connecting to an external power supply, the output module being for electrical connection to all LEDs.

According to a preferred embodiment of the present invention, the input interface is a jack-type interface.

According to a preferred embodiment of the present invention, the jack-type interface is for plugging in one end of a flexible cable, and the other end of the flexible cable is for connecting to an external power supply.

According to a preferred embodiment of the present invention, the output module comprises a same number of output interfaces as the input interfaces, and each output interface is for electrical connection to all LEDs in an external area.

According to a preferred embodiment of the present invention, the input module is located on a front side of the connector and the output module is located on a back side of the connector.

According to a preferred embodiment of the present invention, the connector has a shape of rectangle or square.

According to a preferred embodiment of the present invention, the connector and the circuit board are formed in a single injection molding.

According to a preferred embodiment of the present invention, the connector is soldered to the circuit board.

The efficacy of the present invention is that to be distinguished from the state of the art. By disposing at least two input interfaces at the connector, the present invention realizes the use of a connector to control LEDs in a plurality of areas to increase the utilization of the connector and simplify the LED light bar structure. In the mean time, the improvement of the connector utilization results in the reduction in the number of connectors used so as to reduce the cost of LED light bar.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following refers to drawings and embodiment of the present invention for detailed description.

Figure 1:
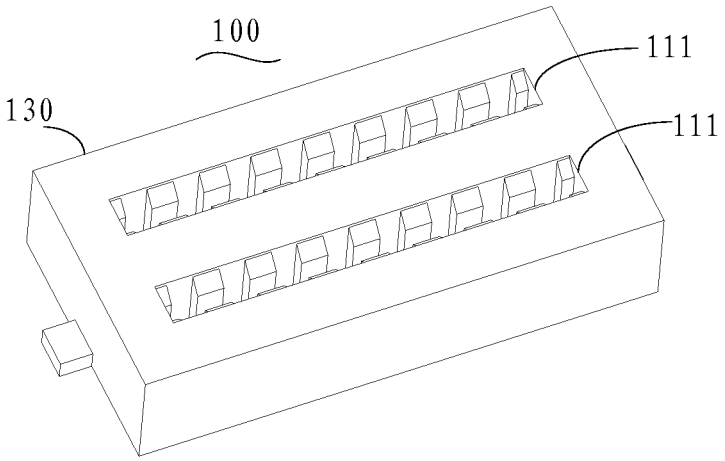
FIG. 1 is a schematic view showing the structure of an embodiment of the connector according to the present invention.
Figure 2:
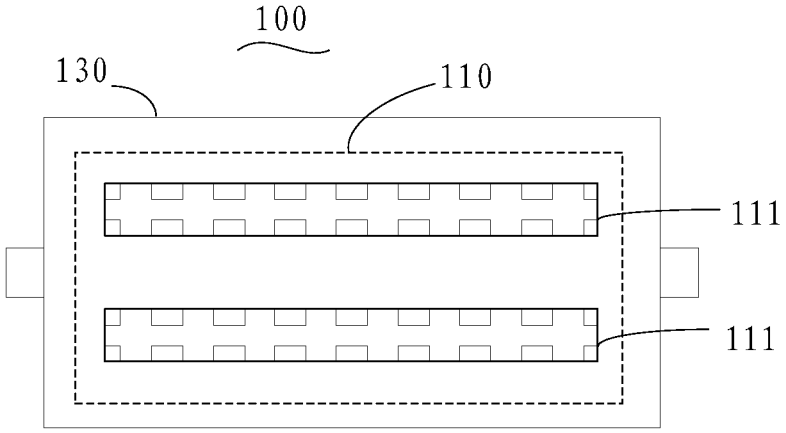
FIG. 2 is a top view showing the structure of an embodiment of the connector according to the present invention.
Figure 3:
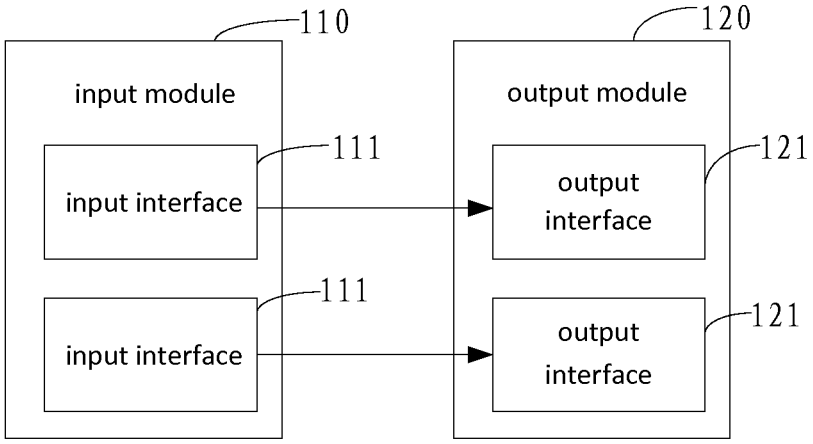
FIG. 3 is a schematic view showing the circuit of an embodiment of the connector according to the present invention.

Referring to FIGS. 1-3, FIG. 1 is a schematic view showing the structure of an embodiment of the connector according to the present invention; FIG. 2 is a top view showing the structure of an embodiment of the connector according to the present invention; and FIG. 3 is a schematic view showing the circuit of an embodiment of the connector according to the present invention.

In the instant embodiment, a connector 100 comprises: a shell 130, an input module 110 and an output module 120, fixed inside the shell 130. The input module 110 and the output module 120 are electrically connected. The input module 100 comprises two input interfaces 111 and the input module 110 is for connecting to an external power supply. The output module 120 is for electrical connection to all LEDs in two corresponding external areas, wherein he two corresponding external areas are two areas on the LED light bar where the connector 100 is disposed on.

Specifically, the input interface 111 is a jack-type interface and is for plugging in one end of a flexible cable, and the other end of the flexible cable is for connecting to an external power supply. The input interface is electrically connected through the flexible cable to the external power supply, and through the output module 120 to realize supplying electricity to external LEDs, wherein the external LEDs are the LEDs disposed on the same circuit board as the connector 100. Correspondingly, each input interface 111 realizes power supply control to all LEDs in an area on the circuit board. The voltage of the external power supply is DC12V. It should be noted that the external power supply is not limited to 12V. The specific voltage is determined by the LED light bar where the connector 100 is disposed on.

Preferably, the output module 120 comprises a same number of output interfaces 121 as the input interfaces 111. Each output interface 121 and each input interface 111 are correspondingly connected and each output interface 121 is for electrical connection to all LEDs in an area of the same circuit board where the connector 100 is disposed on. Each input interface 111 realizes the power supply control to all LEDs of an area in the circuit board through corresponding output interface 121.

In the instant embodiment, the input module 110 is located on a front side of the connector 100 and the output module 120 is located on a back side of the connector 100. However, the present invention is not restricted to the disposition in the instant embodiment that the input module 110 is located on a front side of the connector 100 and the output module 120 is located on a back side of the connector 100. The connector 100 has a shape of a rectangle. Similarly, the present invention is not restricted to the disposition in the instant embodiment. The connector 100 can also be shaped as a square or other shape suitable for the structure of LED light bar where the connector 100 is disposed on.

For convenience of description, the embodiment shows that the input module 110 comprises two input interfaces 111 and realizes power supply control to all LEDs in two areas through the output module 120 correspondingly. However, the present invention is not restricted to the disposition in the instant embodiment of comprising two input interfaces 111 and realizing power supply control to all LEDs in two areas through the output module 120 correspondingly. The input module 110 can comprises more than two input interfaces 111, for example, the input module 110 can comprise three input interfaces 111. Also, the number of areas controlled by the connector is not necessarily the same as the number of input interfaces. For example, a connector 100 having two input interfaces 111 can also realize the power supply control to: all LEDs in one area. In addition; the input interface 111 is disposed as a jack-type interface for plugging in a flexible cable. However, the present invention is not restricted to the disposition in the instant embodiment of a jack-type interface for plugging in a flexible cable.

In the instant embodiment, the present invention realizes the use of a connector 100 to control more LEDs by disposing the connector 100 with two input interfaces 111 to improve utilization of connector 100 and meet the control demands of the complex LED light bar. In addition, each input interface 111 supplies power to an area on the circuit board so that the LEDs can be separately controlled by the area.

Figure 4:
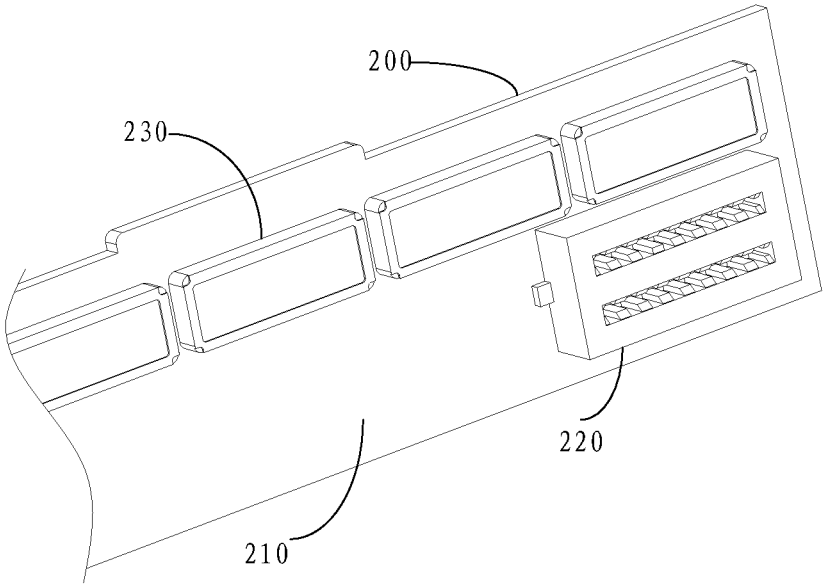
FIG. 4 is a schematic view showing a part of an embodiment of an LED light bar according to the present invention.

Referring to FIG. 4, FIG. 4 is a schematic view showing a part of an embodiment of an LED light bar according to the present invention. In the instant embodiment; an LED light bar 200 comprises: a circuit 210, a connector 220 and LEDs 230. The connector 220 and LEDs 230 are disposed on the circuit board 210. The connector 220 and the LEDs 230 are electrically connected, wherein the description of connector 220 is as in FIGS. 1-3, and will not be repeated here.

In the instant embodiment, the two input interfaces of the connector 220 are for connecting to an external power supply. The output module of the connector 220 is connected respectively with conductive wire of the circuit board 210 connecting all LEDs 230 in corresponding area. LEDs 230 are electrically connected to one of the conductive wires of the circuit board 210 connecting to the output module of the connector 220. The connector 220 is electrically connected to all LEDs 230 in corresponding areas through the circuit board 210 to realize power supply control to all LEDs 230 in corresponding areas, wherein the voltage external power supply is DC 12V. It should be noted that the external power supply is not limited to 12V. The specific voltage is determined by the LED light bar where the connector 200 is disposed on.

Preferably, each input interface of connector 220 is electrically connected through the output module to all LEDs 230 in an area of the circuit board 210 correspondingly. Through a plurality of input interfaces, the connector 220 realizes power supply control to all LEDs in a plurality of areas on the circuit board 210.

In a specific embodiment, the fixing manner of the circuit board 210 and the connector 220 comprises, but not limited to, (1) the connector 220 and the circuit board 210 are formed in a single injection molding, wherein the connector 220 and the circuit board 210 are formed in a single injection molding during manufacturing the circuit board 210; and (2) the connector 220 is soldered to the circuit board 210, wherein the connector 220 is soldered to the circuit board 210 during manufacturing LED light bar 200.

In the instant embodiment, by disposing at least two input interfaces 220 at the connector 220, the present invention realizes the use of a connector 220 to control LEDs 230 in a plurality of areas to increase the utilization of the connector 220 and simplify the structure of LED light bar 200. In the mean time, the improvement of the connector 220 utilization results in the reduction in the number of connectors used so as to reduce the cost of LED light bar 200.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A connector, which comprises: an input module and an output module, wherein the input module and the output module are electrically connected, the input module comprises at least two input interfaces including a first input interface and a second input interface mutually independent from each other, the output module comprises a same number of output interfaces as the input interfaces;

the first input interface is a jack-type interface for plugging in one end of a flexible cable and the other end of the flexible cable is for connecting to an external power supply, and the first input interface further is for supplying electricity from the external power supply to LEDs in an external area through a first one of the output interfaces; and the second input interface is a jack-type interface for plugging in one end of another flexible cable and the other end of the another flexible cable is for connecting to the external power supply, and the second input interface further is for supplying electricity from the external power supply to LEDs in another external area through a second one of the output interfaces.

2. A connector, which comprises: an input module and an output module, wherein the input module and the output module being electrically connected; the input module comprising at least two input interfaces, the input interface being for connecting to an external power supply, the output module being for electrical connection to all LEDs in at least two external areas including a first external area and a second external area; and the at least two input interfaces comprising a first input interface and a second input interface mutually independent from each other, the first input interface and the second input interface being for supplying electricity from the external power supply to the first external area and the second external area respectively through the output module.

3. The connector as claimed in claim 2, characterized in that the input interface is a jack-type interface.

4. The connector as claimed in claim 3, characterized in that the jack-type interface is for plugging in one end of a flexible cable, and the other end of the flexible cable is for connecting to the external power supply.

5. The connector as claimed in claim 2, characterized in that the output module comprises a same number of output interfaces as the input interfaces, and each output interface is for electrical connection to all LEDs in one of the at least two external areas.

6. The connector as claimed in claim 2, characterized in that the input module is located on a front side of the connector and the output module is located on a back side of the connector.

7. The connector as claimed in claim 2, characterized in that the connector has a shape rectangle or square.

8. An LED light bar, which comprises: a circuit board, LEDs and a connector; the LEDs and the connector being disposed on the circuit board, the circuit board being disposed with at least two areas for disposing LEDs, the connector comprising an input module and an output module, wherein the input module and the output module are electrically connected, the input module comprises at least two input interfaces including a first input interface and a second input interface mutually independent from each other, the output module comprises at least two output interfaces including a first output interface and a second output interface;

the first input interface is for connecting to an external power supply and thereby supplying electricity to the LEDs in one of the at least two areas of the circuit board sequentially through the first output interface and a conductive wire of the circuit board; and the second input interface is for connecting to the external power supply and thereby supplying electricity to the LEDs in another one of the at least two areas of the circuit board sequentially through the second output interface and another conductive wire of the circuit board.

9. The light bar as claimed in claim 8, characterized in that the input interface is a jack-type interface.

10. The light bar as claimed in claim 9, characterized in that the jack-type interface is for plugging in one end of a flexible cable, and the other end of the flexible cable is for connecting to the external power supply.

11. The light bar as claimed in claim 8, characterized in that the output module comprises a same number of output interfaces as the input interfaces.

12. The light bar as claimed in claim 8, characterized in that the input module is located on a front side of the connector and the output module is located on a back side of the connector.

13. The light bar as claimed in claim 8, characterized in that the connector has a shape rectangle or square.

14. The light bar as claimed in claim 8, characterized in that the connector and the circuit board are formed in a single injection molding and thereby the first and second output interfaces are electrically connected to the LEDs in the at least two areas of the circuit board essentially through the conductive wires of the circuit board.

15. The light bar as claimed in claim 8, characterized in that the connector is soldered to the circuit board and thereby the first and second output interfaces are electrically connected to the LEDs in the at least two areas of the circuit board essentially through the conductive wires of the circuit board.

* * * * *